US005597674A

United States Patent [19]

Suzuki et al.

[11] Patent Number: 5,597,674

[45] Date of Patent: Jan. 28, 1997

[54] TONER RESIN COMPOSITION AND TONER

[75] Inventors: Tatsuo Suzuki, Shiga-ken; Takashi Ueyama, Kusatsu, both of Japan

[73] Assignee: Sekisui Chemical Co., Ltd., Osaka, Japan

[21] Appl. No.: 499,549

[22] Filed: Jul. 7, 1995

[30] Foreign Application Priority Data

Jul. 7, 1994 [JP] Japan ..... 6-155740

[51] Int. Cl.$^6$ ..... G03G 9/087

[52] U.S. Cl. ..... 430/109

[58] Field of Search ..... 430/106, 109, 430/110, 111

[56] References Cited

U.S. PATENT DOCUMENTS 4,966,829 10/1990 Yasuda et al. ..... 430/109

FOREIGN PATENT DOCUMENTS 4120153 11/1941 Japan .
446397 3/1944 Japan .
53-127726 11/1978 Japan .
56-158340 12/1981 Japan .
57-141452 9/1982 Japan .
58-202455 11/1983 Japan .

*Primary Examiner*—John Goodrow
*Attorney, Agent, or Firm*—Townsend & Banta

[57] ABSTRACT

A toner resin composition is provided which is superior in anti-offset properties, anti-smearing properties and low temperature fixability, has superior image stability even when the copier is used for a long duration of time, and is not prone to aggregation. The toner resin composition mainly comprises a vinyl-type copolymer(s) which contains a low polymer component which is cross-linked using a cross-linking agent comprising diacrylate or dimethacrylate obtained from a diol which has a linear chain with a carbon number of 5 or more with no branches, or a branch(es) with a carbon number of 1 or less and has a peak molecular weight in the molecular weight distribution curve of from about $4\times10^3$ to $8\times10^4$ and a non-cross-linked high polymer component which has a peak molecular weight in the molecular weight distribution curve of from about $1\times10^5$ to $4\times10^6$, wherein said vinyl-type copolymer mainly comprises styrene-type monomers with (meth)acrylic ester monomers and/or other vinyl-type monomers as structural units.

15 Claims, No Drawings

TONER RESIN COMPOSITION AND TONER

FIELD OF THE INVENTION

The present invention relates in general to a toner resin composition and toner used in electrophotography, and more particularly, to a toner resin composition and toner used in the so-called dry developing method.

BACKGROUND OF THE INVENTION

A conventional electrophotography method utilizes photoconductive material using various means to form electrical latent images on a photosensitive matter, developing these latent images with toner, transferring the images to a transfer matter such as a sheet of paper if necessary, and fixing them with a heat source such as heating rollers to form permanent visible images.

The dry developing method is widely used to develop electrostatic charge images in the electrophotography described above. In the dry developing method, a 2-component fine powder developing agent is used which contains a toner prepared by dispersing a coloring agent such as dyes and pigments into a resin and a carrier comprising iron powder or glass beads or a one component fine powder developing agent which uses a magnetic toner prepared by dispersing magnetic substance particles such as magnetite into a toner is used.

In the dry developing method, the toner electrified by friction adheres to electrostatic latent images on photosensitive matter due to electrical attraction, thus forming toner images. The toner images on the photosensitive matter are then transferred to a sheet, and the transferred toner is fixed on the sheet to form permanent visible images.

For the fixing process described above, the so-called heated roller method is widely used in which the toner images on said sheet are pressed onto the surface of the heated roller, which has a toner-separating material formed on its surface, as the sheet goes through. In the heated roller method, a toner resin composition which can be fixed at a lower temperature is desirable so as to improve the cost efficiency, including power consumption, and increase the copying speed.

In order to improve the low temperature fixability, a toner resin composition mainly comprising a vinyl-type copolymer(s) with a lower molecular weight has been proposed. However, although the low temperature fixability of the toners is improved by these methods, there were problems in that a phenomenon in which part of the image forming toner is transferred to the surface of the heated roller during fixation and the toner is then transferred to the next paper sheet and contaminates the images ("the offset phenomenon") tends to occur. Also, the toner tends to aggregate.

RELATED PRIOR ART

To prevent these problems, a toner resin composition(s) with a lower molecular weight polymer component and a higher molecular weight polymer component (Japanese unexamined patent publication Tokkai Sho 56-158340, Tokkai Sho 58-202455) has been proposed. However, there is a problem in that the low molecular weight polymer is brittle and the toner fixed on the paper sheet tends to develop aggregation shattering, leading to smearing.

Electrification control substance(s) such as dyes and pigments are added to a toner of a developing agent in order to control frictional electrification. These electrification control substances give the toner a positive or negative charge and are disclosed in Japanese examined patent publication Tokko Sho 41-20153, Tokko Sho 44-6397, Tokkai Sho 53-127726, Tokkai Sho 57-141452, etc.

Although these electrification control substances demonstrated sufficient performance as an electrification control agent for toner, they did not disperse sufficiently into the resin. Therefore, the toner using the electrification control substances described above was not necessarily satisfactory in terms of higher image quality and stability in the running test.

In recent years, personal use of copiers has increased and, in particular, demand for higher image quality and higher durability has increased. Therefore, a toner resin whose performance is compatible with higher image quality and higher durability is sought.

SUMMARY OF THE INVENTION

The object of the present invention is to provide a toner resin composition and toner which solve the shortcomings of conventional toner resin compositions and toners, allows higher image quality, has superior image stability when the copier is used for a long duration of time, and is superior in non-aggregation characteristics, anti-offset characteristics and anti-smearing characteristics.

The present invention has been devised to achieve the objects described above. The toner resin composition according to present invention comprises a toner resin composition mainly comprising a vinyl-type copolymer(s) wherein: said vinyl-type copolymer contains a cross-linked low polymer component which has a peak molecular weight at a low molecular weight and a non-cross-linked high polymer component which has a peak molecular weight at a high molecular weight; said low polymer component being cross-linked using a cross-linking agent comprising diacrylate or dimethacrylate obtained from a diol which has a linear chain with a carbon number of 5 or more with no branches or a branch(s) with a carbon number of 1 or less, and a peak molecular weight in a molecular weight distribution curve from about of $4\times10^3$ to $8\times10^4$; the peak molecular weight in a molecular weight distribution curve of said high polymer component is from about $1\times10^5$ to $4\times10^6$; and, said vinyl-type copolymer mainly comprising styrene-type monomers with (meth)acrylic ester monomers and/or other vinyl-type monomers as structural units.

In the present invention, the aforementioned cross-linking is preferably achieved with diacrylate or dimethacrylate obtained from a diol which has a linear chain with a carbon number of 5 or more and no branches or, more preferably with diacrylate or dimethacrylate obtained from a diol which has a linear-chain aliphatic alkyl group with a carbon number of 5 or more and no branches.

The toner obtained by the present invention characteristically contains, as major ingredients, the toner resin composition described above, and coloring agent(s).

The toner resin composition and toner of the present invention are described in detail below.

DETAILED DESCRIPTION OF THE INVENTION

The toner resin composition of the present invention has a vinyl-type copolymer(s) as the main ingredient. Also, this vinyl-type copolymer contains a low polymer component which has a peak molecular weight at a low molecular weight in the molecular weight distribution, and a high polymer component which has a peak molecular weight at a high molecular weight.

In the present invention, the strength of the toner resin is enhanced by cross-linking the aforementioned low polymer component which has a peak molecular weight at a low molecular weight, and thus smearing resistance is improved. Furthermore, the cross-linking of the aforementioned low polymer component makes the molecular weight distribution of said low polymer component broader, and thus the low polymer component is more easily dispersed in the high polymer component. As a result, the electrification control agent can be dispersed more uniformly, resulting in higher stability of images.

Furthermore, the aforementioned cross-linking agent has a linear chain with a carbon number of 5 or more. That is, the low polymer component is loosely cross-linked by the cross-linking agent with relatively long chains. This prevents the melting temperature of the resin itself from rising too high, thus ensuring a sufficient fixability at low temperatures.

The molecular weight distribution described above is a molecular weight distribution as measured by means of gel permeation chromatography. In said molecular weight distribution, the low polymer component and the high polymer component described above have their peak molecular weights in the ranges mentioned above.

The vinyl-type copolymer of the present invention should preferably have styrene-type monomers, or acrylic ester or methacrylic ester monomers as structural units so that the basic characteristics of a toner including electrification characteristics and crushability can be obtained.

Specific examples of the styrene-type monomers used in the present invention are: styrene, o-methylstyrene, m-methylstyrene, p-methylstyrene, α-methylstyrene, p-ethylstyrene, 2,4-dimethylstyrene, p-n-butylstyrene, p-ter-butylstyrene, p-n-hexylstyrene, p-n-octylstyrene, p-n-dodecylstyrene, p-methoxystyrene, p-phenylstyrene, p-chlorostyrene and 3,4-dichlorostyrene.

Specific examples of the acrylic ester and methacrylic ester monomers preferably used in the present invention are: alkyl esters of acrylic acid or methacrylic acid, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate and stearyl methacrylate; and also 2-chloroethyl acrylate, phenyl acrylate, methyl α-chloro acrylate, phenyl methacrylate, dimethylaminoethyl methacrylate, diethylaminoethyl methacrylate, 2-hydroxyethyl methacrylate, glycidyl methacrylate, bisglycidyl methacrylate, polyethyleneglycol dimethacrylate and methacryloxyethyl phosphate. More preferably used are ethyl acrylate, propyl acrylate, butyl acrylate, methyl methacrylate, ethyl methacrylate, propyl methacrylate and butyl methacrylate.

Examples of other vinyl type monomers used in the present invention are: acrylic acid and its α or β-alkyl derivatives such as acrylic acid, methacrylic acid, α-ethyl acrylic acid and crotonic acid; unsaturated dicarboxylic acids as well as their monoester derivatives and diester derivatives such as fumaric acid, maleic acid, citraconic acid and itaconic acid; and also monoacryloyloxyethylester succinate, monomethacryloyloxyethylester succinate, acrylonitrile, methacrylonitrile and acrylamide.

The selection of the vinyl-type copolymer in the present invention is not limited in particular as long as it comprises at least a low polymer component which has a peak(s) at a low molecular weight and high polymer component which has a peak(s) at a high molecular weight and is commonly used as a toner resin. The peak in the molecular weight distribution of said cross-linked low polymer component which has a peak at a low molecular weight is from about $4\times10^3$ to $8\times10^4$.

The cross-linking agent used in the present invention comprises diacrylate or dimethacrylate obtained from a diol which has a linear chain with a carbon number of 5 or more with a branch(es) with a carbon number of 1 or less. Specific examples of these crosslinking agent include triethyleneglycol dimethacrylate, tetraethyleneglycol dimethacrylate, polyethyleneglycol dimethacrylate, tripropyleneglycol dimethacrylate, polypropyleneglycol dimethacrylate, ditetramethyleneglycol dimethacrylate, polytetramethyleneglycol dimethacrylate, 1,5-pentanediol dimethacrylate, 1,6-hexanediol dimethacrylate, 1,7-heptanediol dimethacrylate, 1,8-octanediol dimethacrylate, 1,9-nonanediol dimethacrylate, 1,10-decanediol dimethacrylate, polyethylenediol dimethacrylate, triethyleneglycol diacrylate, tetraethyleneglycol diacrylate, polyethyleneglycol diacrylate, tripropyleneglycol diacrylate, polypropyleneglycol diacrylate, ditetramethyleneglycol diacrylate, polytetramethyleneglycol diacrylate, 1,5-pentanediol diacrylate, 1,6-hexanediol diacrylate, 1,7-heptanediol diacrylate, 1,8-octanediol diacrylate, 1,8-nonanediol diacrylate, 1,10-decanediol diacrylate, polyethylenediol diacrylate, neopentylglycol hydroxypivalate, neopentylglycol hydroxypivalate modified caprolactone and ECH modified 1,6-hexanediol diacrylate. Considering the reaction characteristics and such, particularly preferable are 1,5-pentanediol dimethacrylate, 1,6-hexanediol dimethacrylate, 1,5-pentanediol diacrylate and 1,6-hexanediol diacrylate.

When the carbon number of the linear chain of the cross-linking agent is 5 or less and/or the chain is not a linear chain and/or the branch(es) is too long and/or the cross-linking agent is tri- (or greater) functional, the degree of freedom of the resin in the molten state is reduced partly because the cross link density is too high. Therefore the flowability in the molten state decreases, and fixation at low temperatures becomes impossible. Furthermore, uniform dispersion in the high polymer component becomes more difficult and thus the dispersion becomes inhomogeneous, leading to reduced long-term stability of the images.

The amount of the cross-linking agent used is about 0.1 to 10 wt % more preferably about 0.2 to 3 wt % in the polymer which has a peak at a low molecular weight. If it is less than about 0.1%, then sufficient effects cannot be obtained. If it is more than about 10 wt %, then the cross link density becomes too high, and the degree of freedom of the resin in the molten state is reduced, and therefore the flowability decreases, and fixation at low temperatures becomes impossible. Furthermore, uniform dispersion in the high polymer component becomes more difficult and, thus, the dispersion becomes inhomogeneous, leading to reduced long term stability of the images.

For said non-cross-linked high polymer component which has a peak molecular weight at a high molecular weight, the peak molecular weight is in the range of about $1\times10^5$ to $4\times10^6$. If it is smaller than this range, then the anti-offset properties may deteriorate. If it is larger than this range or if cross-linking is done, then dispersion with the low polymer component becomes inhomogeneous and the long term stability of the images is reduced.

In said vinyl-type copolymer comprising the low molecular weight component and the high molecular weight component, if the content of the high polymer component is less than about 10 wt %, then the anti-offset properties may deteriorate and, therefore, about 20 wt % or more is preferable. On the other hand, if it is about 70 wt % or more, then it may not be possible to keep the fixing temperature low enough and, therefore, about 40 wt % or less is preferable.

For the vinyl-type copolymer of the present invention, in view of the aggregation properties, it is desirable that the glass transition temperature be about 50° C. or higher.

The vinyl-type copolymer can be synthesized by means of suspension polymerization, emulsion polymerization, solution polymerization, bulk polymerization, etc. The vinyl-type copolymer can be heat-melt-blended. However, in order to make it more uniform, it is preferable to disperse it in a solvent and then remove the solvent. A more preferred alternative is to polymerize the low molecular weight component in the presence of the high molecular weight component.

In the toner resin composition of the present invention, vinyl acetate, vinyl chloride, ethylene, etc. can be copolymerized with said vinyl-type copolymer, or a polymer of these monomers can be blended into it, within the range where the object of the present invention can be achieved. Polyester resin and/or epoxy resin can also be mixed in. In addition, aliphatic amides, bisaliphatic amides, metal soaps, paraffin, etc. can also be mixed in.

The toner of the present invention contains the toner resin composition described above and a coloring agent as the major ingredients. That is, the toner can be provided by mixing the coloring agent, described later, into the toner resin composition described above.

For the coloring agent described above, carbon black, chrome yellow, aniline blue, etc. can be used.

In addition, for the electrification control agent, dyes such as Nigrosine and Spiron Black (from Hodogaya Kagaku) and phthalocyanine-type pigments can be added to the toner of the present invention, within the range where the object of the present invention can be achieved.

Further, low molecular weight polyethylene, polypropylene wax, etc. can be added as a separating agent, and hydrophobic silica and such can be added to increase flowability.

The major ingredient of the toner resin composition of the present invention is a vinyl-type copolymer which contains the aforementioned low polymer component and high polymer component. Since the low polymer component is cross-linked by the aforementioned cross-linking agent, the strength of the toner resin is heightened. Therefore, the anti-smearing properties are improved.

The cross-linking of the aforementioned low polymer component makes the molecular weight distribution of said low polymer component broader, and thus the low polymer component is more easily dispersed in the high polymer component. As a result, the electrification control agent can be dispersed more uniformly in the toner resin composition, resulting in higher long-term stability of images.

In addition, the low polymer component described above is loosely cross-linked by the cross-linking agent with relatively long chains. This prevents the melting temperature of the resin itself from rising too high, thus ensuring a sufficiently low temperature fixability.

The toner according to the present invention contains the toner resin composition and coloring agent. Since the dispersibility in the toner resin composition is increased, the coloring agent is uniformly dispersed.

The toner resin composition of the present invention mainly comprises a vinyl-type copolymer(s) and said vinyl-type copolymer contains the low polymer component cross-linked by a cross-linking agent with relatively long chains and the non-cross-linked high polymer component described above. Due to this, the resin strength can be increased and a toner with superior anti-smearing properties can be provided. In addition, since the dispersibility of the low polymer component in the high polymer component is increased, the electrification control agent, coloring agent, etc. can be dispersed more uniformly and, thus, the long-term stability of images can be increased and a toner not prone to aggregation can be obtained. Furthermore, since the low polymer component is loosely cross-linked by the specific cross-linking agent described above, sufficient low temperature fixability can be ensured as well.

Accordingly, by using the toner resin composition of the present invention, it is possible to provide a toner which is not prone to aggregation, is superior in anti-offset properties, anti-smearing properties, low temperature fixability, as well as stability of images when used in a copier for a long duration of time.

The present invention is clarified below by describing non-limiting examples of the present invention. In the following description, "part" means "weight part" unless specified otherwise.

EXAMPLE 1

1000 g of toluene and 200 g of a copolymer which is prepared by copolymerizing 70 parts of styrene and 30 parts of 2-ethylhexyl acrylate and has a peak molecular weight of 600,000 were put into a 3-liter separatable flask. After the gas phase was replaced by nitrogen gas as the system was being stirred, the temperature was raised to the boiling point of toluene.

After the refluxing of toluene had begun, a dissolved mixture of 780 g of styrene, 200 g of n-butyl methacrylate, 1,6-hexanediol dimethacrylate, as a cross-linking agent, and 15 g of azobisisobutyronitrile, as a polymerization starter, was dripped into the system over 6 hours while stirring, during which the solution polymerization took place. After the completion of dripping, the system was aged for 6 hours with stirring at the boiling temperature of toluene. The system temperature was then gradually raised to 180° C., while toluene was removed under reduced pressure. The composition was then cooled and crushed to obtain the toner resin composition A of the present invention which had a low polymer component with a peak molecular weight of approximately 10,000. The glass transition point Tg of resin A was 60° C. The peak molecular weight value was obtained from the molecular weight distribution measured by means of gel permeation chromatography.

100 weight parts of resin A, 5 weight parts of carbon black (from Mitsubishi Chemical Industries, Ltd., product name: MA-100), 1 weight part of Spiron Black TRH and 3 weight parts of polypropylene wax (from Sanyo Chemical Industries, Ltd., product name: Viscol 660P) were melt-blended, cooled, coarsely crushed and then finely crushed with a jet-mill to obtain toner powder with an average particle size of approximately 13–15 micrometers.

10 g of the toner powder thus obtained was put into a 100 ml sample bottle and let stand for 16 hours in a 50° C. thermostatic bath, followed by measurement of the degree of aggregation using a powder tester (from Hosokawa Micron, Ltd.). No aggregation was observed.

Four weight parts of this toner powder and 96 weight parts of an iron powder carrier with an average particle size of approximately 50 to 80 micrometers were mixed to prepare a developing agent, and copies were made using this developing agent. The electrophotographic copier used was a modified DC-4085 manufactured by Mita Industrial Co. Ltd.

Copies were made at various temperatures of the heating roller of the electrophotographic copier. Said copies were then rubbed with a typewriter eraser [a rubber eraser with fine abrasive particles in it, called a "sand eraser" in Japan and used for erasing letters typed in ink], and the temperature setting at which the density of the copy images changed after rubbing was defined as the lowest fixing temperature. The lowest fixing temperature of the developing agent using resin A was 150° C., which was sufficiently low.

The offset occurring temperature was defined as the temperature setting at which the offset phenomenon occurs when obtaining copies at various temperature settings of the heating roller of the electrophotographic copier. The offset occurring temperature of the developing agent using resin A was 200° C. or higher, which was sufficiently high.

Half-tone images were copied using this developing agent, and uniform high-quality images were obtained. Also, a running test of 50,000 copies was conducted. As a result, absolutely no disruption of half-tone images was observed.

Half-tone images were rubbed with a finger. Hardly any smearing was observed.

EXAMPLE 2

1,000 g of xylene was put into a 3-liter separatable flask. After the gas phase was replaced by nitrogen gas, this system was heated to the boiling point of xylene.

After the refluxing of xylene had begun, a dissolved mixture of 800 g of styrene, 195 g of n-butyl acrylate, 1,5-pentanediol acrylate, as a cross-linking agent, and 25 g of benzoyl peroxide, as a polymerization starter, was dripped into the system over 5 hours while stirring, during which the solution polymerization took place. After the dripping was completed, 5 hours of aging was conducted while stirring continued at the boiling point of xylene. The system temperature was then gradually raised to 180° C., while xylene was removed under reduced pressure, to obtain a resin with a peak molecular weight of approximately 20,000.

700 g of the resin thus obtained, 300 g of a resin with a peak molecular weight of 1,000,000 prepared by polymerizing 80 parts of styrene and 20 parts of n-butyl acrylate and 1,000 g of xylene were put into a 3-liter separatable flask. After the gas phase was replaced by nitrogen gas, this system was stirred and heated to the boiling point of xylene.

After the refluxing of xylene had begun, 1 hour of stirring was conducted. The system temperature was then gradually raised to 180° C., while xylene was removed under reduced pressure. The composition was then cooled and crushed to obtain resin B of the present invention. The glass transition point Tg of resin B was 62° C.

A developing agent was prepared and tests were conducted in the same manner as in Example 1 except for the fact that resin B was used instead of resin A. No aggregation was observed. The lowest fixing temperature was 150° C. and the offset occurring temperature was 200° C. or higher.

Half-tone images were copied using this developing agent, and uniform high-quality images were obtained. Also, a running test of 50,000 copies was conducted. Although the result was somewhat inferior compared with the toner of Example 1, no disruption of half-tone images was observed.

Half-tone images were rubbed with a finger. Hardly any smearing was observed.

EXAMPLE 3

The developing agent was prepared and tests were conducted in the same manner as in Example 2 except for the fact that tetraethyleneglycol diacrylate was used instead of 1,5-pentanediol diacrylate. The peak molecular weight of the low polymer component thus obtained was approximately 20,000, and the Tg of the resin was 60° C.

No aggregation was observed, the lowest fixing temperature was 150° C., and the offset occurring temperature was 200° C. or lower.

Half-tone images were copied using this developing agent, and, although the result was inferior compared with the toner of Example 2, uniform images were obtained. Also, a running test of 50,000 copies was conducted. Although the result was somewhat inferior compared with the toner of Example 2, no disruption of half-tone images was observed.

Half-tone images were rubbed with a finger. Although the result was somewhat inferior compared with the toner of Example 2, hardly any smearing was observed.

COMPARATIVE EXAMPLE 1

The developing agent was prepared and tests were conducted in the same manner as in Example 1 except for the fact that the cross-linking agent was not used. The peak molecular weight of the resin thus obtained was approximately 10,000, and the Tg of the resin was 59° C.

No aggregation was observed. The lowest fixing temperature was 150° C. and the offset occurring temperature was 200° C. or higher. However, the uniformness of half-tone images was inferior compared with Examples 1–3, and a running test of 50,000 copies resulted in somewhat disrupted images.

Half-tone images were rubbed with a finger and smearing was observed.

COMPARATIVE EXAMPLE 2

The developing agent was prepared and tests were conducted in the same manner as in Example 1 except for the fact that the amount of the polymerization starter azobisisobutyronitrile was 120 g instead of 40 g. The peak molecular weight of the resin thus obtained was approximately 3,000, and the Tg of the resin was 42° C.

The fixing temperature was 130° C., and the offset occurring temperature was 190° C. However, aggregation was observed. The uniformness of half-tone images was inferior, and some disruption of images was clearly observed in a running test of 50,000 copies. Half-tone images were rubbed with a finger, and severe smearing was observed.

COMPARATIVE EXAMPLE 3

The developing agent was prepared and tests were conducted in the same manner as in Example 1 except for the fact that the amount of the polymerization starter azobisisobutyronitrile was 4 g instead of 40 g. The peak molecular weight of the resin thus obtained was approximately 100,000, and the Tg of the resin was 65° C.

No aggregation was observed, and the offset occurring temperature was 200° C. or higher. However, the lowest fixing temperature was 180° C., which was high. The uniformness of half-tone images was inferior, and disruption of images was clearly observed in a running test of 50,000 copies.

Half-tone images were rubbed with a finger, and no smearing was observed.

COMPARATIVE EXAMPLE 4

The developing agent was prepared and tests were conducted in the same manner as in Example 2 except for the fact that the resin with a peak molecular weight of 1,000,000 was not used. The peak molecular weight of the resin thus obtained was approximately 20,000, and the Tg of the resin was 60° C.

No aggregation was observed, and the fixing temperature was 150° C. Half-tone images had superior uniformness, and no disruption of images was observed in a running test of 50,000 copies. However, the offset occurring temperature was 160° C., which was low. Half-tone images were rubbed with a finger, and some smearing was observed.

COMPARATIVE EXAMPLE 5

The developing agent was prepared and tests were conducted in the same manner as in Example 2 except for the fact that divinylbenzene was used instead of 1,5-pentanediol acrylate. The peak molecular weight of the resin thus obtained was approximately 20,000, and the Tg of the resin was 60° C.

No aggregation was observed, and the offset occurring temperature was 200° C. or higher. However, the lowest fixing temperature was 180° C., which was high. The uniformness of half-tone images was inferior, and disruption of images was clearly observed in a running test of 50,000 copies.

Half-tone images were rubbed with a finger, and no smearing was observed.

resin thus obtained was approximately 20,000, and the Tg of the resin was 60° C.

No aggregation was observed, and the offset occurring temperature was 200 ° C. or higher. However, the lowest fixing temperature was 170° C., which was high. The uniformness of half-tone images was inferior, and disruption of images was clearly observed in a running test of 50,000 copies.

Half-tone images were rubbed with a finger, and no smearing was observed.

COMPARATIVE EXAMPLE 7

The developing agent was prepared and tests were conducted in the same manner as in Example 2 except for the fact that the resin with a peak molecular weight of 1,000,000 was replaced by a resin with a gel content of 90% and the Same composition. The peak molecular weight of the resin thus obtained was approximately 20,000, and the Tg of the resin was 60 ° C.

No aggregation was observed, and the offset occurring temperature was 200° C. or higher. However, the lowest fixing temperature was 160° C., which was higher than those of the examples. The uniformness of half-tone images was inferior, and disruption of images was clearly observed in a running test of 50,000 copies.

Half-tone images were rubbed with a finger, and no smearing was observed.

The results of Examples 1–3 and Comparative Examples 1–7 described above are summarized in Tables 1 and 2 attached hereto and made a part hereof.

TABLE 1

| EXAMPLE | 1 | 2 | 3 |
|---|---|---|---|
| TONER AGGREGATION | Not Observed | Not Observed | Not Observed |
| LOWEST FIXING TEMPERATURE (°C.) | 150° C. | 150° C. | 150° C. |
| OFFSET OCCURRING TEMPERATURE | 200° C. | 200° C. | 200° C. |
| DISPRUTED HALF-TONE IMAGES | Not Observed | Not Observed | Not Observed |
| SMEARING | Not Observed | Not Observed | Hardly Any |

TABLE 2

| | COMPARATIVE EXAMPLES | | | | | | |
|---|---|---|---|---|---|---|---|
| | 1 | 2 | 3 | 4 | 5 | 6 | 7 |
| Toner Aggregation | Not Observed | Aggregation Observed | Not Observed | Not Observed | Not Observed | Not Observed | Not Observed |
| Lowest Fixing Temperature (°C.) | 150° C. | 130° C. | 180° C. | 150° C. | 180° C. | 170° C. | 160° C. |
| Offset Occurring Temperature | 200° C. or higher | 190° C. or higher | 200° C. or higher | 160° C. | 200° C. or higher | 200° C. or higher | 200° C. or higher |
| Disrupted Half-Tone Images | Not Observed | Disruption Observed | Disruption Observed | Not Observed | Disruption Observed | Disruption Observed | Disruption Observed |
| Smearing | Observed | Severe Smearing | Not Observed | Some Smearing | Not Observed | Not Observed | Not Observed |

COMPARATIVE EXAMPLE 6

The developing agent was prepared and tests were conducted in the same manner as in Example 2 except for the fact that pentaerythritol tetra-acrylate was used instead of 1,5-pentanediol acrylate. The peak molecular weight of the

What is claimed is:

1. A toner resin composition mainly comprising vinyl-type copolymer(s) wherein: said vinyl-type copolymer contains a cross-linked low polymer component which has a peak molecular weight at a low molecular weight and a non-cross-linked high polymer component which has a peak molecular weight at a high molecular weight; said low polymer component being cross-linked using a cross-linking agent comprising diacrylate or dimethacrylate obtained from a diol which has a linear chain with a carbon number of 5 or more with no branches or a branch(es) with a carbon number of 1 or less, and has a peak molecular weight in a molecular weight distribution curve of from about $4\times10^3$ to $8\times10^4$; the amount of cross-linking agent used being about 0.1 to 10 wt % in the polymer which has a peak at a low molecular weight; the peak molecular weight in the molecular weight distribution curve of said high polymer component being from about $1\times10^5$ to $4\times10^6$; and, said vinyl-type copolymer mainly comprising styrene-type monomers with (meth-)acrylic ester monomers and/or other vinyl-type monomers as structural units.

2. The toner resin composition of claim 1, wherein said cross-linking agent is diacrylate or dimethacrylate obtained from a diol which has a linear chain with a carbon number of 5 or more and no branches.

3. The toner resin composition of claim 2, wherein said cross-linking agent is diacrylate or dimethacrylate obtained from a diol which has a linear-chain aliphatic alkyl group with a carbon number of 5 or more and no branches.

4. A toner resin composition of claim 1, comprising a coloring agent(s).

5. A toner resin composition of claim 2, comprising coloring agent(s).

6. A toner resin composition of claim 3, comprising coloring agent(s).

7. The toner resin composition of claim 1, wherein the vinyl-type copolymer has a glass transition temperature of 50° C. or higher.

8. The toner resin composition of claim 1, wherein the low molecular weight component is polymerized in the presence of the high molecular weight component.

9. The toner resin composition of claim 2, wherein the amount of cross-linking agent used is about 0.3 to 3 wt % in the polymer which has a peak at a low molecular weight.

10. The toner resin composition of claim 1, wherein said high polymer component comprises from 10 to 70 wt % of said vinyl-type copolymer.

11. A toner containing the resin composition of claim 10.

12. A toner containing the toner resin composition of claim 1.

13. A toner containing a toner resin composition of claim 3.

14. A toner containing the toner resin composition of claim 7.

15. A toner containing the toner resin composition of claim 8.

* * * * *